US011376719B2

(12) United States Patent
Thomas et al.

(10) Patent No.: US 11,376,719 B2
(45) Date of Patent: Jul. 5, 2022

(54) MULTI-TOOL ASSEMBLY

(71) Applicants: Daniel Thomas, Lincolnton, NC (US); Kevin Duhaime, Lincolnton, NC (US)

(72) Inventors: Daniel Thomas, Lincolnton, NC (US); Kevin Duhaime, Lincolnton, NC (US)

( * ) Notice: Subject to any disclaimer, the term of this patent is extended or adjusted under 35 U.S.C. 154(b) by 352 days.

(21) Appl. No.: 16/742,536

(22) Filed: Jan. 14, 2020

(65) Prior Publication Data

US 2021/0213589 A1 Jul. 15, 2021

(51) Int. Cl.

| | |
|---|---|
| ***B25B 15/04*** | (2006.01) |
| ***B25B 23/00*** | (2006.01) |
| ***B25G 1/08*** | (2006.01) |

(52) U.S. Cl.

CPC ..... *B25B 15/04* (2013.01); *B25B 23/0028* (2013.01); *B25B 23/0035* (2013.01); *B25G 1/085* (2013.01)

(58) Field of Classification Search

CPC . B25B 15/04; B25B 23/0028; B25B 23/0035; B25G 1/085

USPC ... 81/490, 177.4, 177.6, 177.8, 177.9, 177.7

See application file for complete search history.

(56) References Cited

U.S. PATENT DOCUMENTS

| | | | | |
|---|---|---|---|---|
| 2,773,529 | A * | 12/1956 | Valenti | B25B 15/02 81/34 |
| 4,827,812 | A | 5/1989 | Markovetz | |
| 4,924,733 | A | 5/1990 | McKenzie | |
| 5,178,047 | A | 1/1993 | Arnold | |
| 5,964,132 | A | 10/1999 | Chen | |
| 6,151,994 | A * | 11/2000 | Shiao | B25B 15/04 81/438 |
| 6,305,255 | B1 | 10/2001 | Wu | |
| 6,490,955 | B2 * | 12/2002 | Chang-Kao | B25G 1/085 81/439 |
| 6,524,035 | B1 * | 2/2003 | Robison | B23B 31/1071 81/177.4 |
| 8,333,134 | B1 | 12/2012 | Duffy | |
| 10,065,302 | B2 * | 9/2018 | Wilkinson | B25F 1/02 |
| 2011/0083536 | A1 * | 4/2011 | Palmisano | B25B 23/0042 81/439 |
| 2013/0269117 | A1 | 10/2013 | Wilkinson | |

* cited by examiner

*Primary Examiner* — Hadi Shakeri

(57) ABSTRACT

A multi-tool assembly includes a grip and a receiver that is extendable through the grip. The receiver has a first half pivotally coupled to a second half thereby facilitating the receiver to be bent into a plurality of angles. A plurality of bits is provided and each of the bits is insertable into a respective one of the first wells or the second wells for storage. Each of the bits is positionable into the receiver to tighten or loosen a fastener. A ratchet is integrated into the grip and the ratchet engages the receiver when the receiver is extended through the grip. The ratchet facilitates the grip to ratchet around the receiver in either a first direction or a second direction. In this way the grip can be rotated back and forth around the receiver for tightening or loosening the fastener.

13 Claims, 6 Drawing Sheets

MULTI-TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to multi-tool devices and more particularly pertains to a new multi-tool device for loosening or tightening fasteners.

(2) Description of Related Art Including Information Disclosed Under 37 CFR 1.97 and 1.98

The prior art relates to multi-tool devices. The prior art discloses a variety of multi-tools with a plurality of bits. In each of these cases the multi-tools include a ratchet and an elongated receiver. In none of these cases is a bendable receiver claimed. The prior art discloses a ratcheting socket wrench to loosening or tightening bolts with a socket. In many of these cases a variety of spring loaded locks and corresponding detents are included to facilitate slidable adjustments.

BRIEF SUMMARY OF THE INVENTION

An embodiment of the disclosure meets the needs presented above by generally comprising a grip and a receiver that is extendable through the grip. The receiver has a first half pivotally coupled to a second half thereby facilitating the receiver to be bent into a plurality of angles. A plurality of bits is provided and each of the bits is insertable into a respective one of the first wells or the second wells for storage. Each of the bits is positionable into the receiver to tighten or loosen a fastener. A ratchet is integrated into the grip and the ratchet engages the receiver when the receiver is extended through the grip. The ratchet facilitates the grip to ratchet around the receiver in either a first direction or a second direction. In this way the grip can be rotated back and forth around the receiver for tightening or loosening the fastener.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
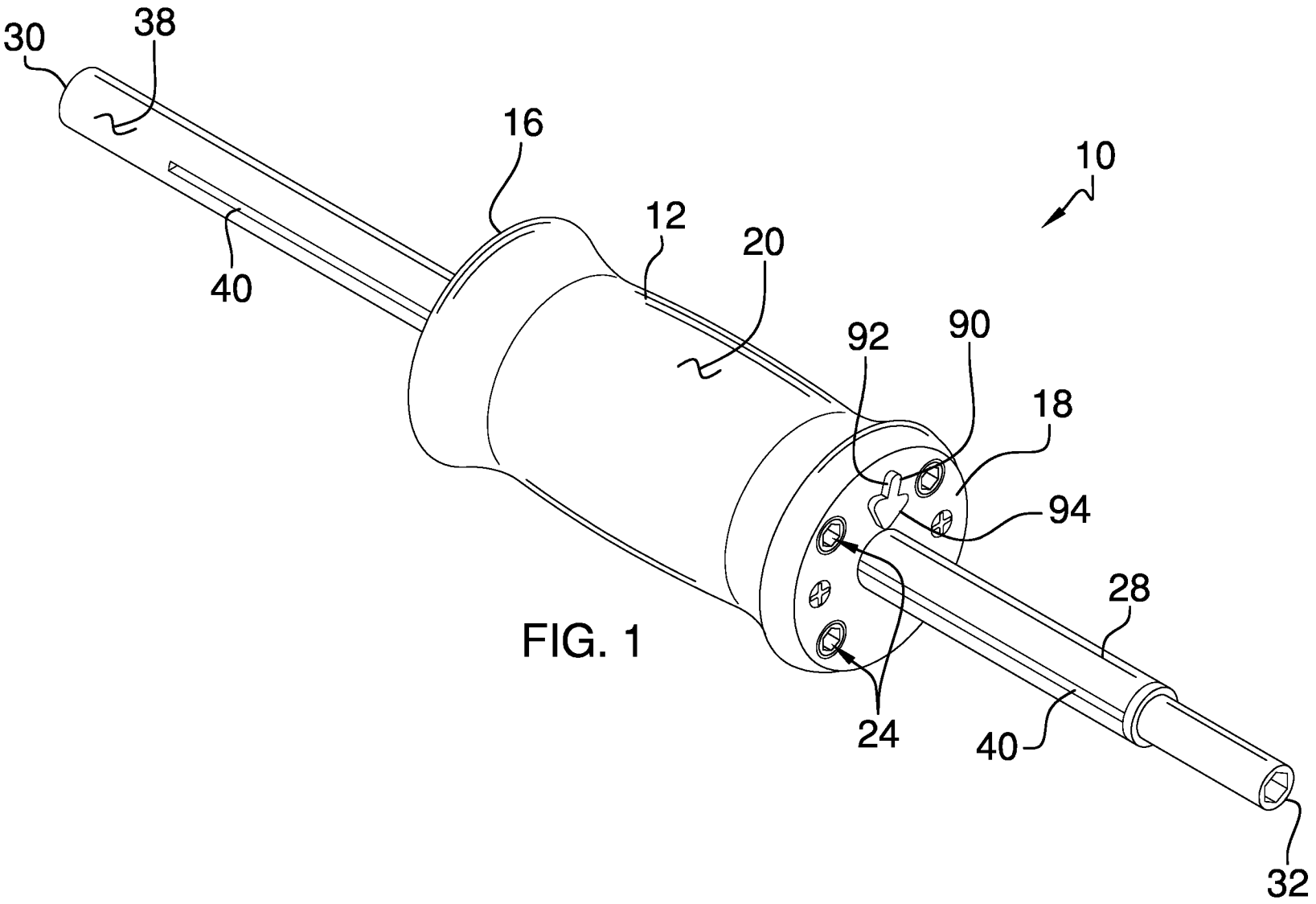
FIG. 1 is a perspective view of a multi-tool assembly according to an embodiment of the disclosure.
Figure 2:
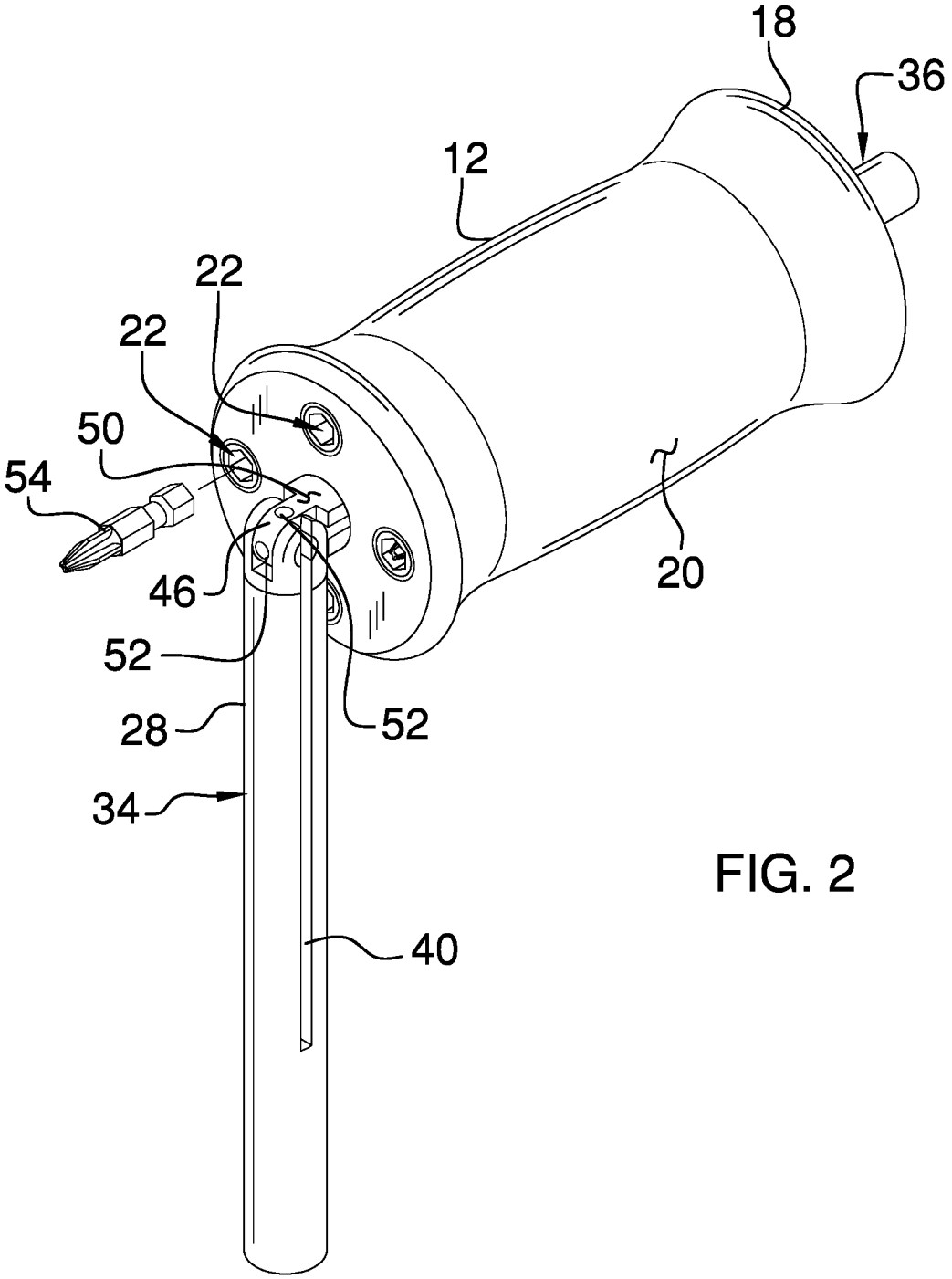
FIG. 2 is a front perspective view of an embodiment of the disclosure showing a receiver being bent.
Figure 3:
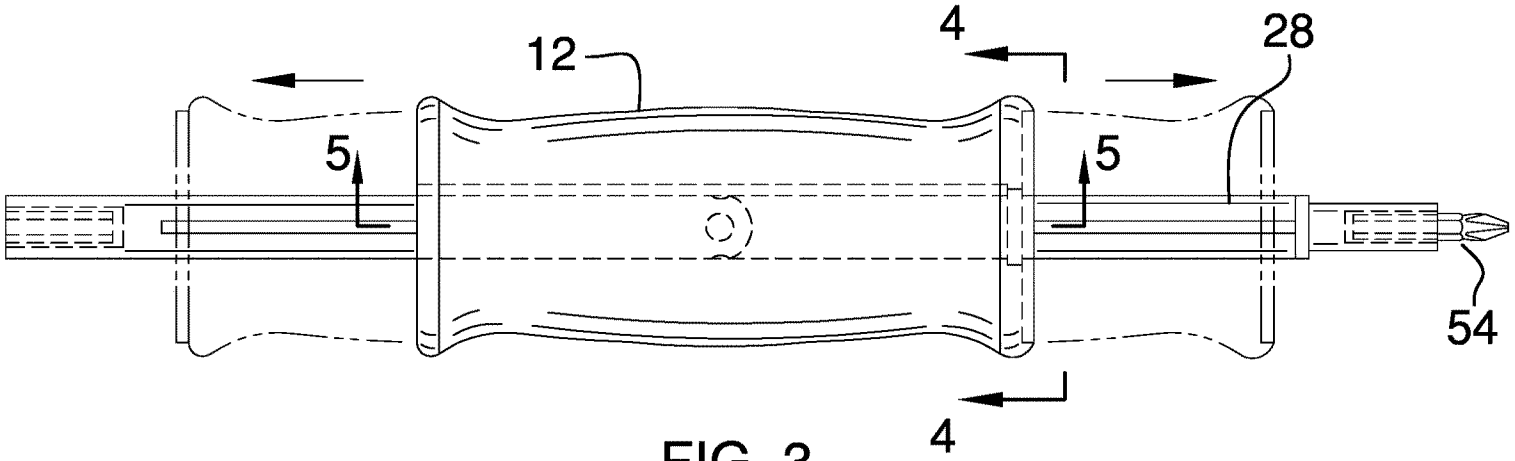
FIG. 3 is a right side phantom view of an embodiment of the disclosure.
Figure 4:
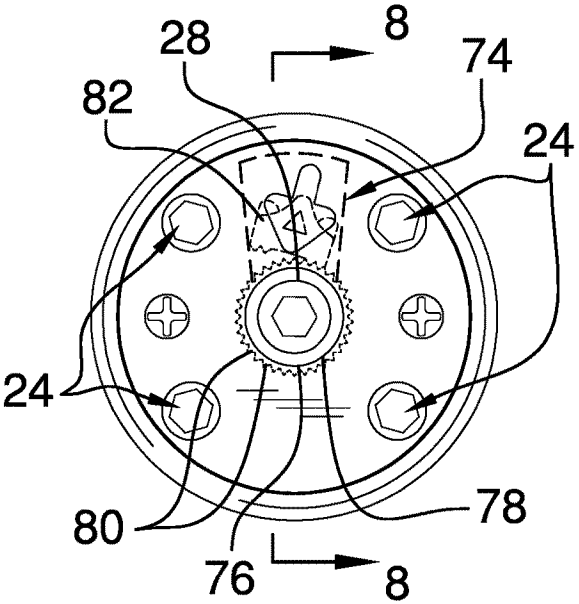
FIG. 4 is a cross sectional view taken along line 4-4 of FIG. 3 of an embodiment of the disclosure.
Figure 5:
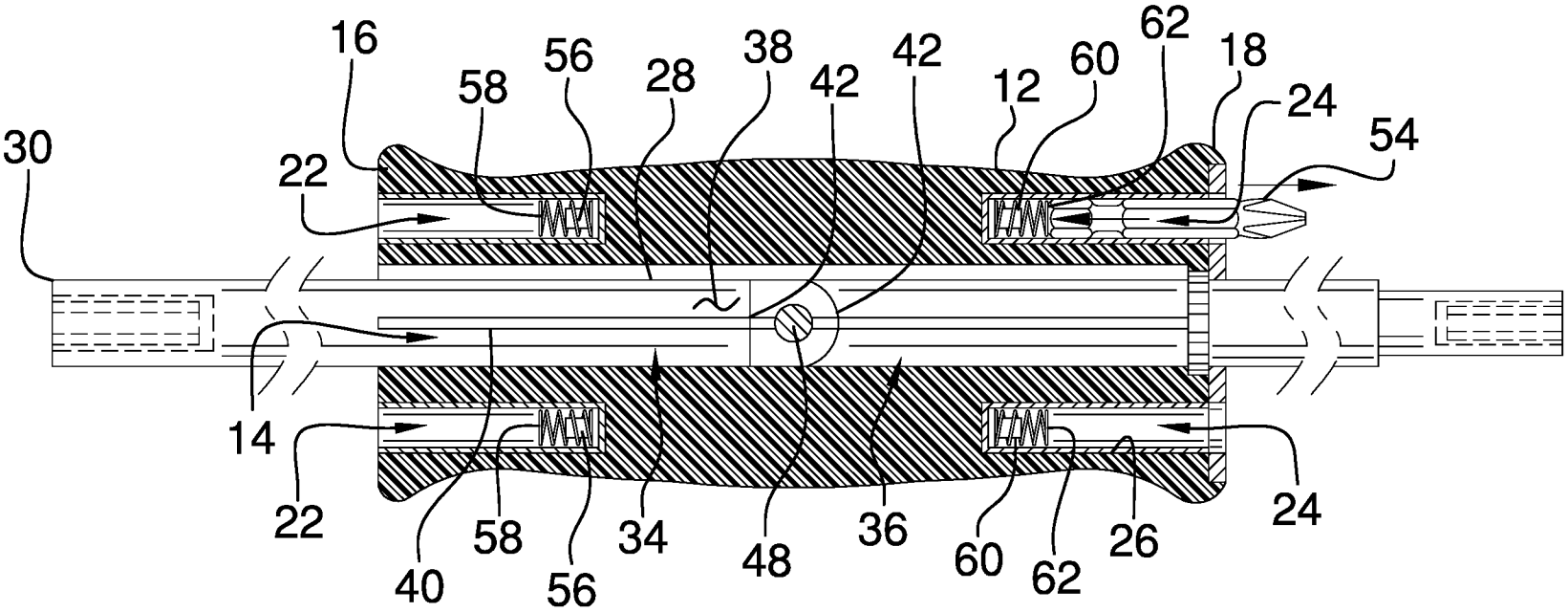
FIG. 5 is a cross sectional view taken along line 5-5 of FIG. 3 of an embodiment of the disclosure.
Figure 6:
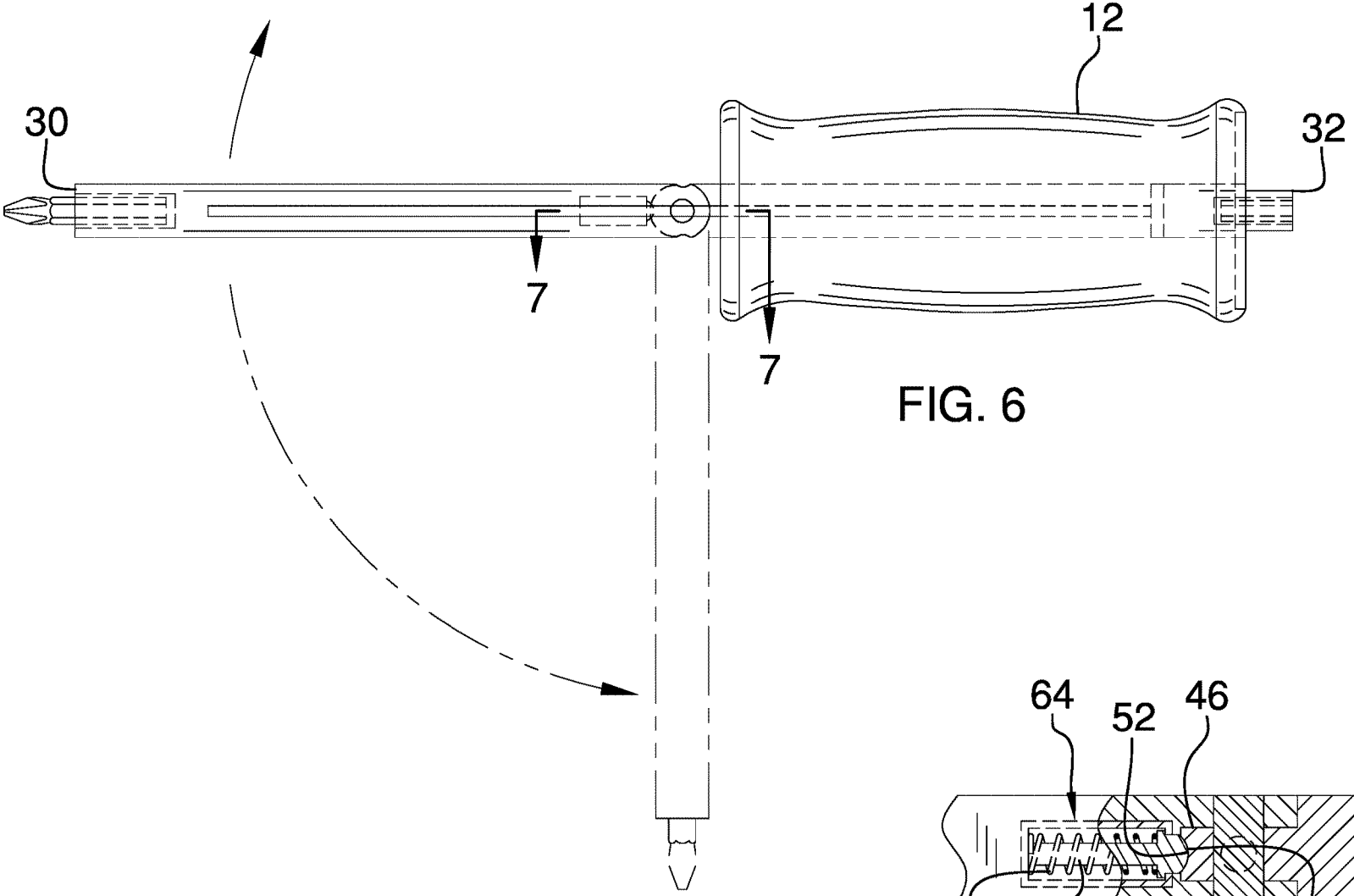
FIG. 6 is a left side phantom view of an embodiment of the disclosure.
Figure 7:
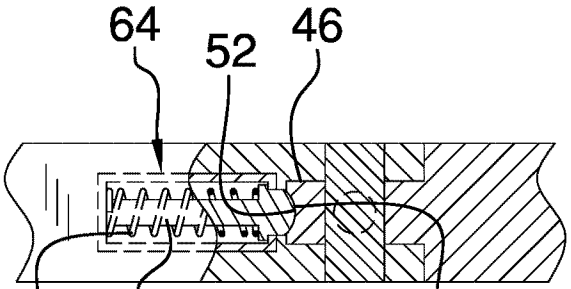
FIG. 7 is a cross sectional view taken along line 7-7 of FIG. 6 of an embodiment of the disclosure.
Figure 8:
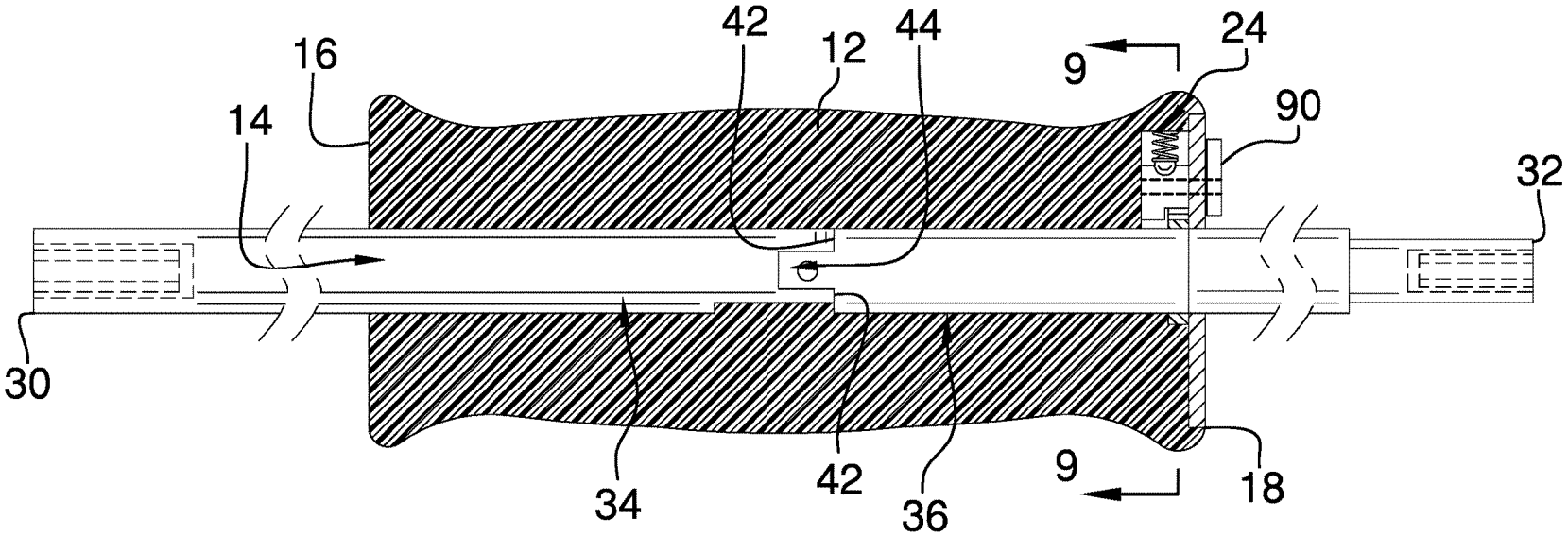
FIG. 8 is a cross sectional view taken along line 8-8 of FIG. 2 of an embodiment of the disclosure.
Figure 9:
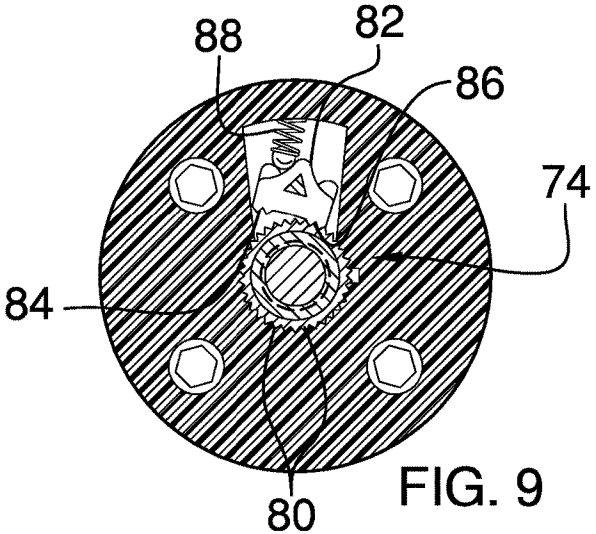
FIG. 9 is a cut-away view of a grip, a sleeve and a gear of an embodiment of the disclosure.

With reference now to the drawings, and in particular to FIGS. 1 through 9 thereof, a new multi-tool device embodying the principles and concepts of an embodiment of the disclosure and generally designated by the reference numeral 10 will be described.

As best illustrated in FIGS. 1 through 9, the multi-tool assembly 10 generally comprises a grip 12 that has an aperture 14 extending therethrough. The grip 12 has a first end 16, a second end 18 and an outer surface 20 extending therethrough, and the aperture 14 extends through the first end 16 and the second end 18. The outer surface 20 is continuously arcuate about the aperture 14 such that the grip 12 has a cylindrical shape. Additionally, the outer surface 20 flares outwardly adjacent to each of the first end 16 and the second end 18 to inhibit a user's hand from sliding off of the grip 12.

The first end 16 has a plurality of first wells 22 each extending toward the second end 18. The first wells 22 are spaced apart from each other and are distributed around the aperture 14. The second end 18 has a plurality of second wells 24 each extending toward the first end 16. The second wells 24 are spaced apart from each other and are distributed around the aperture 14. Each of the first wells 22 and the second wells 24 has a bounding surface 26, and the bounding surface 26 may have a plurality of intersecting sides such that each of the first wells 22 and the second wells 24 has a hexagonal shape.

A receiver 28 is included that has a primary end 30 and a secondary end 32, and the receiver 28 is elongated between the first end 16 and the second end 18. The receiver 28 is insertable through the aperture 14 having each of the primary end 30 and the secondary end 32 being exposed, and each of the first end 16 and the second end 18 is open. The receiver 28 has a first half 34 that is pivotally coupled to a second half 36 thereby facilitating the receiver 28 to be bent into a plurality of angles.

The receiver 28 has an outer surface 38, the outer surface 38 of the receiver 28 has a slot 40 extending therein and the slot 40 extends between the primary end 30 and the secondary end 32. Each of the first half 34 and the second half 36 has a coupling end 42. The coupling end 42 of the first half 34 has a channel 44 extending therein, the coupling end 42 of the second half 36 has a tab 46 extending away therefrom and the tab 46 is positioned in the channel 44. The receiver 28 includes a pin 48 extending through the channel 44 and engaging the tab 46 for pivotally retaining the first half 34 to the second half 36. Additionally, the tab 46 has an outwardly facing surface 50 and the outwardly facing surface 50 has a plurality of detents 52 thereon. Additionally, the outwardly facing surface 50 is concavely arcuate with respect to the coupling end 42 of the second half 36.

A plurality of bits 54 is provided and each of the bits 54 is insertable into a respective one of the first wells 22 or the second wells 24 for storage. Each of the bits 54 is positionable into either the primary end 30 or the secondary end 32 of the receiver 28 to engage a fastener for tightening or loosening the fastener. Each of the bits 54 is structured to engage a unique type of fastener to tighten or loosen a variety of fasteners. The bits 54 may include Phillips bits, flat head bits, socket drivers, allen bits and any other type of bit for engaging threaded fasteners. Additionally, the aperture 14 in the receiver 28 and each of the bits 54 may have a hexagonal profile to inhibit the bits 54 from rotating in the receiver 28.

A plurality of first magnets 56 is each positioned in a respective one of the first wells 22 thereby facilitating each of the first magnets 56 to magnetically attract the bits 54 for retaining the bits 54 in the first wells 22. A plurality of first springs 58 is each positioned in a respective one of the first wells 22. Each of the first springs 58 engages the bit 54 that is inserted into the respective first well 22. In this way the bit 54 is inhibited from contacting the first magnet 56 in the respective first well 22 thereby enhancing removing the bits 54 from the respective first well 22.

A plurality of second magnets 60 is each positioned in a respective one of the second wells 24 thereby facilitating each of the second magnets 60 to magnetically attract the bits 54 for retaining the bits 54 in the second wells 24. A plurality of second springs 62 is each positioned in a respective one of the second wells 24. Each of the second springs 62 engages the bit 54 that is inserted into the respective second well 24. In this way the bit 54 is inhibited from contacting the second magnet 60 in the respective second well 24 thereby enhancing removing the bits 54 from the respective second well 24.

A lock 64 is integrated into the receiver 28 and the lock 64 is positioned in the first half 34 of the receiver 28. The lock 64 is biased to engage a respective one of the detents 52 in the outwardly facing surface of the tab 46. In this way the receiver 28 is movably retained in a chosen angle. As is most clearly shown in FIG. 7, the lock 64 may include a biasing member 68 that is positioned within the first half 34 and a plunger 70 with a domed end 72. The biasing member 68 may engage the plunger 70 thereby urging the domed end 72 outwardly from the coupling end 42 of the first half 34.

A ratchet 74 is integrated into the grip 12 and the ratchet 74 engages the receiver 28 when the receiver 28 is extended through the grip 12. The ratchet 74 is actuatable to rotate in a first direction or a second direction. The ratchet 74 rotates the receiver 28 in the first direction when the grip 12 is rotated in the first direction and the ratchet 74 is actuated to rotate in first direction. Additionally, the ratchet 74 slips in the grip 12 when the grip 12 is rotated in the second direction and the ratchet 74 is actuated to rotate in the first direction. In this way the receiver 28 is inhibited from rotating in the second direction.

The ratchet 74 rotates the receiver 28 in the second direction when the grip 12 is rotated in the second direction and the ratchet 74 is actuated to rotate in second direction. The ratchet 74 slips in the grip 12 when the grip 12 is rotated in the first direction and the ratchet 74 is actuated to rotate in the second direction. In this way the ratchet 74 inhibits the receiver 28 from rotating in the first direction. Thus, the ratchet 74 facilitates the grip 12 to be rotated back and forth for tightening or loosening the fastener.

The ratchet 74 comprises a sleeve 76 that extends through the aperture 14 and the sleeve 76 is rotatable in the aperture 14. The sleeve 76 has an outer surface 78 and the outer surface 78 of the sleeve 76 has a plurality of teeth 80 thereon that are distributed around an entire circumference of the sleeve 76. The sleeve 76 engages the slot 40 in the receiver 28 when the receiver 28 is extended through the sleeve 76 such that the receiver 28 is rotatably coupled to the sleeve 76.

The ratchet 74 includes a gear 82 that is pivotally positioned in the grip 12, and the gear 82 has a first engagement point 84 and a second engagement point 86. The first engagement point 84 engages the teeth 80 on outer surface 20 of the sleeve 76 when the gear 82 is positioned in a first position. The first engagement point 84 slips along the teeth 80 when the grip 12 is rotated in the second direction and the gear 82 is in the first position thereby inhibiting the sleeve 76 from rotating the receiver 28. Conversely, the first engagement point 84 engages the teeth 80 when the grip 12 is rotated in the first direction and the gear 82 is in the first position thereby facilitating the sleeve 76 to rotate the receiver 28.

The second engagement point 86 engages the teeth 80 on outer surface 20 of the sleeve 76 when the gear 82 is positioned in a second position. The second engagement point 86 slips along the teeth 80 when the grip 12 is rotated in the first direction and the gear 82 is in the second position thereby inhibiting the sleeve 76 from rotating the receiver 28. Conversely, the second engagement point 86 engages the teeth 80 when the grip 12 is rotated in the second direction and the gear 82 is in the second position thereby facilitating the sleeve 76 to rotate the receiver 28.

The ratchet 74 includes a biasing member 88 that is positioned within the grip 12 and the biasing member 88 engages the gear 82. Additionally, the biasing member 88 retains the gear 82 in either the first position or the second position. A lever 90 is movably coupled to the first end 16 of the grip 12 and the lever 90 is in mechanical communication with the gear 82. The lever 90 urges the gear 82 between the first position and the second position when the lever 90 is manipulated. In this way the direction of rotation of the receiver 28 can be changed to either loosen or tighten fasteners. The lever 90 may include a stem 92 and a head 94 that tapers to a point such that the lever 90 has an arrow shape.

In use, the receiver 28 is extended through the aperture 14 in the handle and selected bits 54 are inserted into the receiver 28 for tightening or loosening a fastener. The lever 90 is manipulated into the appropriate position for loosening or tightening the fastener. In this way the grip 12 can ratchet 74 around the receiver 28 for loosening or tightening the fastener. The receiver 28 can be pulled outwardly from the grip 12 a sufficient distance to expose the coupling end 42 of the first half 34 and the second half 36. In this way the receiver 28 can be bent to facilitate the grip 12 to act as a lever 90 for rotating the receiver 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A multi-tool assembly being configured to engage a plurality of different types of fasteners, said assembly comprising:

a grip having an aperture extending therethrough, said grip has a first end, a second end and an outer surface extending therethrough, said aperture extending through said first end and said second end, said first end has a plurality of first wells each extending toward said second end, said first wells being spaced apart from each other and being distributed around said aperture, said second end has a plurality of second wells each extending toward said first end, said second wells being spaced apart from each other and being distributed around said aperture;

a receiver having a primary end and a secondary end, said receiver being insertable through said aperture having each of said primary end and said secondary end being exposed, said receiver having a first half being pivotally coupled to a second half thereby facilitating said receiver to be bent into a plurality of angles;

a plurality of bits, each of said bits being insertable into a respective one of said first wells or said second wells for storage, each of said bits being positionable into either said primary end or said secondary end of said receiver wherein each of said bits is configured to engage a fastener to tighten or loosen the fastener, each of said bits being structured to engage a unique type of fastener wherein said receiver is configured to tighten or loosen a variety of fasteners;

a ratchet being integrated into said grip, said ratchet engaging said receiver when said receiver is extended through said grip, said ratchet being actuatable to rotate in a first direction or a second direction, said ratchet rotating said receiver in said first direction when said grip is rotated in said first direction and said ratchet is actuated to rotate in first direction, said ratchet slipping in said grip when said grip is rotated in said second direction and said ratchet is actuated to rotate in said first direction thereby inhibiting said receiver from rotating in said second direction, said ratchet rotating said receiver in said second direction when said grip is rotated in said second direction and said ratchet is actuated to rotate in second direction, said ratchet slipping in said grip when said grip is rotated in said first direction and said ratchet is actuated to rotate in said second direction thereby inhibiting said receiver from rotating in said first direction; and wherein said receiver has an outer surface, said outer surface having a slot extending therein, said slot extending between said primary end and said secondary end, each of said first half and said second half having a coupling end, said coupling end of said first half having a channel extending therein, said coupling end of said second half having a tab extending away therefrom, said tab being positioned in said channel.

2. The assembly according to claim 1, wherein said receiver includes a pin extending through said channel and engaging said tab for pivotally retaining said first half to said second half, said tab having an outwardly facing surface, said outwardly facing surface having a plurality of detents thereon.

3. The assembly according to claim 1, further comprising a plurality of first magnets, each of said first magnets being positioned in a respective one of said first wells thereby facilitating each of said first magnets to magnetically attract said bits for retaining said bits in said first wells.

4. The assembly according to claim 1, further comprising:

a plurality of first magnets; and a plurality of second magnets, each of said second magnets being positioned in a respective one of said second wells thereby facilitating each of said second magnets to magnetically attract said bits for retaining said bits in said second wells.

5. The assembly according to claim 1, further comprising a lock being integrated into said receiver, said lock being positioned in said first half of said receiver, said lock being biased to engage a respective one of said detents in said outwardly facing surface of said tab thereby facilitating said receiver to be movably retained in a chosen angle.

6. The assembly according to claim 1, wherein said ratchet comprises a sleeve extending through said aperture, said sleeve being rotatable in said aperture, said sleeve having an outer surface, said outer surface having a plurality of teeth thereon being distributed around an entire circumference of said sleeve, said sleeve engaging said slot in said receiver when said receiver is extended through said sleeve.

7. The assembly according to claim 6, wherein said ratchet includes a gear being pivotally positioned in said grip, said gear having a first engagement point and a second engagement point, said first engagement point engaging said teeth on outer surface of said sleeve when said gear is positioned in a first position, said first engagement point slipping along said teeth when said grip is rotated in said second direction and said gear is in said first position thereby inhibiting said sleeve from rotating said receiver, said first engagement point engaging said teeth when said grip is rotated in said first direction and said gear is in said first position thereby facilitating said sleeve to rotate said receiver.

8. The assembly according to claim 7, wherein said second engagement point engages said teeth on outer surface of said sleeve when said gear is positioned in a second position, said second engagement point slipping along said teeth when said grip is rotated in said first direction and said gear is in said second position thereby inhibiting said sleeve from rotating said receiver, said second engagement point engaging said teeth when said grip is rotated in said second direction and said gear is in said second position thereby facilitating said sleeve to rotate said receiver.

9. The assembly according to claim 7, wherein said ratchet includes a biasing member being positioned within said grip, said biasing member engaging said gear, said biasing member retaining said gear in either said first position or said second position.

10. The assembly according to claim 7, wherein said ratchet includes a lever being movably coupled to said first end of said grip, said lever being in mechanical communication with said gear, said lever urging said gear between said first position and said second position when said lever is manipulated for changing the direction of rotation of said receiver wherein said receiver is configured to either loosen or tighten fasteners.

11. The assembly according to claim 1, further comprising:

said receiver including a pin extending through said channel and engaging said tab for pivotally retaining said first half to said second half, said tab having an outwardly facing surface, said outwardly facing surface having a plurality of detents thereon;

a plurality of first magnets, each of said first magnets being positioned in a respective one of said first wells thereby facilitating each of said first magnets to magnetically attract said bits for retaining said bits in said first wells;

a plurality of first springs, each of said first springs being positioned in a respective one of said first wells, each of said first springs engaging said bit that is inserted into said respective first well to inhibit said bit from contacting said first magnet in said respective first well thereby enhancing removing said bits from said respective first well;

a plurality of second magnets, each of said second magnets being positioned in a respective one of said second wells thereby facilitating each of said second magnets to magnetically attract said bits for retaining said bits in said second wells;

a plurality of second springs, each of said second springs being positioned in a respective one of said second wells, each of said second springs engaging said bit that is inserted into said respective second well to inhibit said bit from contacting said second magnet in said respective second well thereby enhancing removing said bits from said respective second well;

a lock being integrated into said receiver, said lock being positioned in said first half of said receiver, said lock being biased to engage a respective one of said detents in said outwardly facing surface of said tab thereby facilitating said receiver to be movably retained in a chosen angle; and said first ratchet comprising:

a sleeve extending through said aperture, said sleeve being rotatable in said aperture, said sleeve having an outer surface, said outer surface having a plurality of teeth thereon being distributed around an entire circumference of said sleeve, said sleeve engaging said slot in said receiver when said receiver is extended through said sleeve;

a gear being pivotally positioned in said grip, said gear having a first engagement point and a second engagement point, said first engagement point engaging said teeth on outer surface of said sleeve when said gear is positioned in a first position, said first engagement point slipping along said teeth when said grip is rotated in said second direction and said gear is in said first position thereby inhibiting said sleeve from rotating said receiver, said first engagement point engaging said teeth when said grip is rotated in said first direction and said gear is in said first position thereby facilitating said sleeve to rotate said receiver, said second engagement point engaging said teeth on outer surface of said sleeve when said gear is positioned in a second position, said second engagement point slipping along said teeth when said grip is rotated in said first direction and said gear is in said second position thereby inhibiting said sleeve from rotating said receiver, said second engagement point engaging said teeth when said grip is rotated in said second direction and said gear is in said second position thereby facilitating said sleeve to rotate said receiver;

a biasing member being positioned within said grip, said biasing member engaging said gear, said biasing member retaining said gear in either said first position or said second position; and a lever being movably coupled to said first end of said grip, said lever being in mechanical communication with said gear, said lever urging said gear between said first position and said second position when said lever is manipulated for changing the direction of rotation of said receiver wherein said receiver is configured to either loosen or tighten fasteners.

12. A multi-tool assembly being configured to engage a plurality of different types of fasteners, said assembly comprising:

a grip having an aperture extending therethrough, said grip has a first end, a second end and an outer surface extending therethrough, said aperture extending through said first end and said second end, said first end has a plurality of first wells each extending toward said second end, said first wells being spaced apart from each other and being distributed around said aperture, said second end has a plurality of second wells each extending toward said first end, said second wells being spaced apart from each other and being distributed around said aperture;

a receiver having a primary end and a secondary end, said receiver being insertable through said aperture having each of said primary end and said secondary end being exposed, said receiver having a first half being pivotally coupled to a second half thereby facilitating said receiver to be bent into a plurality of angles;

a plurality of bits, each of said bits being insertable into a respective one of said first wells or said second wells for storage, each of said bits being positionable into either said primary end or said secondary end of said receiver wherein each of said bits is configured to engage a fastener to tighten or loosen the fastener, each of said bits being structured to engage a unique type of fastener wherein said receiver is configured to tighten or loosen a variety of fasteners;

a ratchet being integrated into said grip, said ratchet engaging said receiver when said receiver is extended through said grip, said ratchet being actuatable to rotate in a first direction or a second direction, said ratchet rotating said receiver in said first direction when said grip is rotated in said first direction and said ratchet is actuated to rotate in first direction, said ratchet slipping in said grip when said grip is rotated in said second direction and said ratchet is actuated to rotate in said first direction thereby inhibiting said receiver from rotating in said second direction, said ratchet rotating said receiver in said second direction when said grip is rotated in said second direction and said ratchet is actuated to rotate in second direction, said ratchet slipping in said grip when said grip is rotated in said first direction and said ratchet is actuated to rotate in said second direction thereby inhibiting said receiver from rotating in said first direction;

a plurality of first magnets, each of said first magnets being positioned in a respective one of said first wells thereby facilitating each of said first magnets to magnetically attract said bits for retaining said bits in said first wells; and a plurality of first springs, each of said first springs being positioned in a respective one of said first wells, each of said first springs engaging said bit that is inserted into said respective first well to inhibit said bit from contacting said magnet in said respective first well thereby enhancing removing said bits from said respective first well.

13. A multi-tool assembly being configured to engage a plurality of different types of fasteners, said assembly comprising:

a grip having an aperture extending therethrough, said grip has a first end, a second end and an outer surface extending therethrough, said aperture extending through said first end and said second end, said first end has a plurality of first wells each extending toward said second end, said first wells being spaced apart from each other and being distributed around said aperture, said second end has a plurality of second wells each extending toward said first end, said second wells being spaced apart from each other and being distributed around said aperture;

a receiver having a primary end and a secondary end, said receiver being insertable through said aperture having each of said primary end and said secondary end being exposed, said receiver having a first half being pivotally coupled to a second half thereby facilitating said receiver to be bent into a plurality of angles;

a plurality of bits, each of said bits being insertable into a respective one of said first wells or said second wells for storage, each of said bits being positionable into either said primary end or said secondary end of said receiver wherein each of said bits is configured to engage a fastener to tighten or loosen the fastener, each of said bits being structured to engage a unique type of fastener wherein said receiver is configured to tighten or loosen a variety of fasteners;

a ratchet being integrated into said grip, said ratchet engaging said receiver when said receiver is extended through said grip, said ratchet being actuatable to rotate in a first direction or a second direction, said ratchet rotating said receiver in said first direction when said grip is rotated in said first direction and said ratchet is actuated to rotate in first direction, said ratchet slipping in said grip when said grip is rotated in said second direction and said ratchet is actuated to rotate in said first direction thereby inhibiting said receiver from rotating in said second direction, said ratchet rotating said receiver in said second direction when said grip is rotated in said second direction and said ratchet is actuated to rotate in second direction, said ratchet slipping in said grip when said grip is rotated in said first direction and said ratchet is actuated to rotate in said second direction thereby inhibiting said receiver from rotating in said first direction;

a plurality of first magnets;

a plurality of second magnets, each of said second magnets being positioned in a respective one of said second wells thereby facilitating each of said second magnets to magnetically attract said bits for retaining said bits in said second wells a plurality of first springs; and a plurality of second springs, each of said second springs being positioned in a respective one of said second wells, each of said second springs engaging said bit that is inserted into said respective second well to inhibit said bit from contacting said magnet in said respective second well thereby enhancing removing said bits from said respective second well.

* * * * *